US005950579A

United States Patent [19]

Ott

[11] Patent Number: 5,950,579

[45] Date of Patent: Sep. 14, 1999

[54] INTERNAL COMBUSTION ENGINE

[76] Inventor: Vern D. Ott, 1839 Route 746 South, Cardington, Ohio 43315

[21] Appl. No.: 09/046,488

[22] Filed: Mar. 23, 1998

Related U.S. Application Data

[63] Continuation-in-part of application No. 09/002,672, Jan. 5, 1998.

[51] Int. Cl.[6] ..... F02B 33/02; F02B 75/32

[52] U.S. Cl. ..... 123/54.4; 123/197.3; 123/197.4

[58] Field of Search ..... 123/54.4, 196 V, 123/196 CP, 197.4, 96 R, 54.5, 54.6, 54.7, 54.8, 197.3; 184/6.5, 6.6

[56] References Cited

U.S. PATENT DOCUMENTS

| | | | |
|---|---|---|---|
| 872,571 | 12/1907 | Moser | 123/54.4 |
| 1,360,958 | 11/1920 | Kline | 123/54.4 |
| 1,481,334 | 1/1924 | Allen | 74/580 |
| 1,872,194 | 8/1932 | Summers | 184/6.5 |
| 2,111,242 | 3/1938 | Harley | 184/6.25 |
| 2,780,502 | 2/1957 | Emele | 384/430 |
| 2,974,654 | 3/1961 | Bouvy | 123/54.4 |
| 2,990,819 | 7/1961 | Bouvy | 123/41.74 |
| 3,110,293 | 11/1963 | Reiners | 123/276 |
| 4,307,921 | 12/1981 | Roberts | 384/399 |
| 4,461,585 | 7/1984 | Mahrus et al. | 384/288 |
| 4,889,090 | 12/1989 | Werner et al. | 123/197.4 |
| 5,186,127 | 2/1993 | Cuatico | 123/54 R |
| 5,655,496 | 8/1997 | Pong | 123/197.2 |

*Primary Examiner*—Henry C. Yuen
*Assistant Examiner*—Hai Huynh
*Attorney, Agent, or Firm*—Thomas S. Baker, Jr.

[57] ABSTRACT

A V-type internal combustion engine having a pair of opposed piston cylinders positioned in the same transverse plane is provided with a pair of co-operating pistons that are connected to a singular crankshaft crankpin through a pair of co-operating connecting rods and combined sleeve-type bearings that each lie outside the piston cylinder transverse plane.

4 Claims, 4 Drawing Sheets

FIG. 6
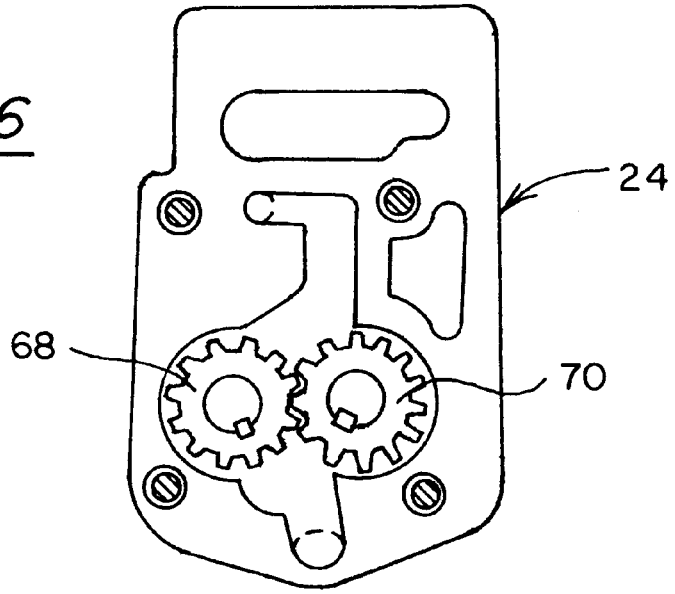
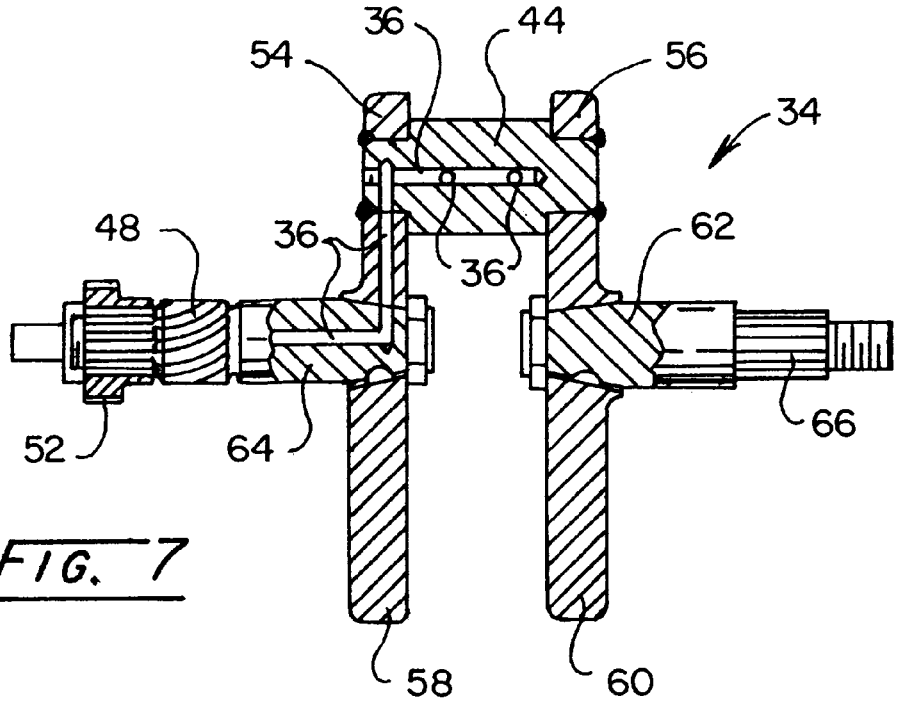
FIG. 7

INTERNAL COMBUSTION ENGINE

CROSS-REFERENCES

This application is a Continuation-In-Part application of application Ser. No. 09/002672 filed Jan. 5, 1998.

FIELD OF THE INVENTION

This invention relates generally to internal combustion engines, and particularly concerns a V-type, two-cylinder, four-stroke cycle, air-cooled internal combustion engine having significantly improved engine operating reliability in comparison to known similar engines when operated at high power levels over extended periods of time.

BACKGROUND OF THE INVENTION

Known V-type, two-cylinder, four-stroke cycle internal combustion engines such as those utilized in numerous motorcycle vehicle applications function satisfactorily during normal highway usage but have a pronounced tendency to fail following extended operation at high output power levels. The modes of failure often are attributed to phenomena such as connecting rod distortion, crankshaft assembly flexing, and insufficient lubricant flow to bearings. In some cases the failure can be further attributed to the use of co-planar connecting rod elements that are conventionally joined to the engine crankshaft assembly crank pin element by means of a combination of straight and forked (clevis-type) connecting rod ends and their attendant connecting rod bearings. This construction may be seen in engines having a pair of opposed pistons the axes of which lie in a common plane perpendicular to the axis of the crankshaft.

I have discovered that the failure frequency of such engines under conditions of high power output may be significantly reduced by incorporating an improved connecting rod end and connecting rod bearing arrangement in such engines. Also, improvements to lubricant flow and lubricant distribution to the connecting rod bearings are achieved in the invention as well as reduced flexing of the engine crankshaft assembly during encountered high speed operation.

Other objects and advantages of the present invention will become apparent during a consideration of the descriptions, drawings, and claims which follow.

SUMMARY OF THE INVENTION

A V-type internal combustion engine having a crankshaft and a pair of generally-opposed piston cylinders whose longitudinal axes are each contained in a single plane that is oriented at right-angles to the longitudinal axis of the crankshaft is provided with a pair of reciprocable piston elements that are installed in the piston cylinders, with a crankshaft single crankpin element positioned intermediate a pair of crankshaft crank arm elements, with a pair of connecting rod elements that co-operate with the pair of piston elements and with the crankshaft single crankpin element, and with sleeve-type bearing elements positioned intermediate each connecting rod element and the crankshaft single crankpin element. An internal lubricant passageway is provided within the crankshaft crank arm elements and co-operating single crankpin element, receives pressurized lubricant from the engine lubricant pump, and ports the pressurized lubricant to zones which lie between the inner surface of the sleeve-type bearing elements and the surface of the crankshaft single crankpin element and which are at approximate 90° and 270° positions relative to the longitudinal axes of the piston elements when the piston elements are positioned at top or bottom dead center in their respective operating strokes.

BRIEF DESCRIPTION OF THE DRAWINGS

FIG. 6 is a section view of the engine lubricating oil pump component taken at line 6—6 of FIG. 1; and FIG. 7 is a partially-sectioned elevation view of the crankshaft element of the internal combustion engine of FIGS. 1 through 6.

DETAILED DESCRIPTION

Figure 1:
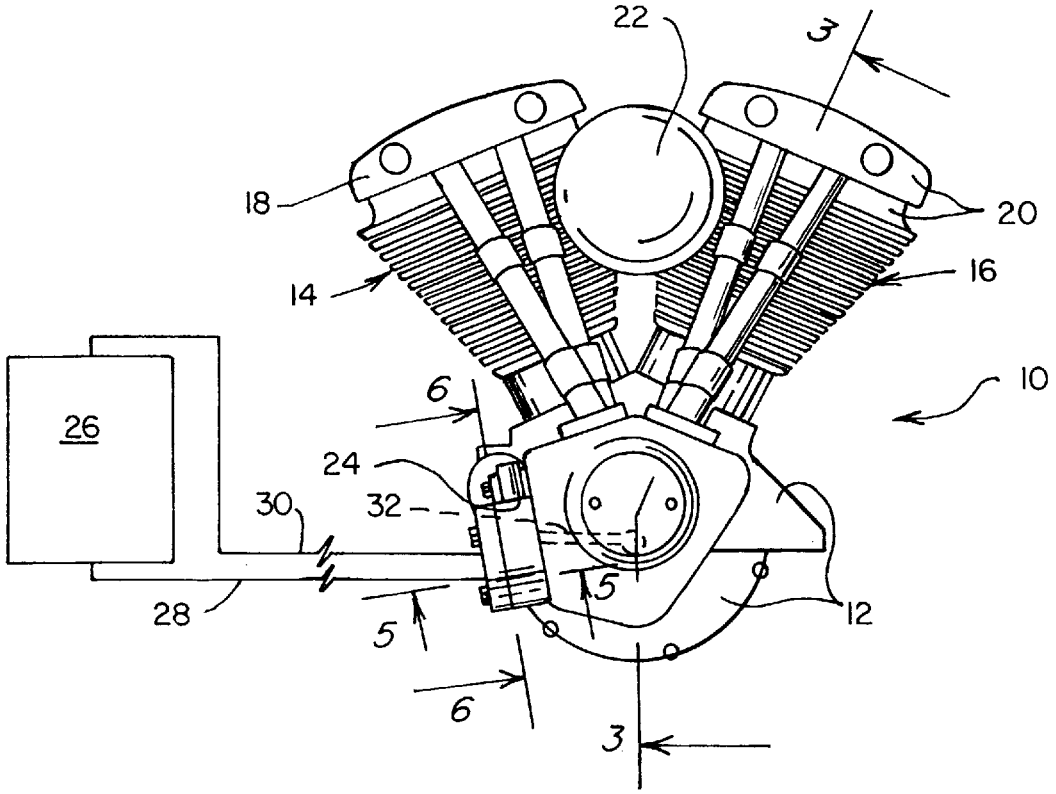
FIG. 1 is an elevation view, partially schematic, of a preferred embodiment of the two-cylinder, four-stroke internal combustion engine of the present invention.
Figure 2:
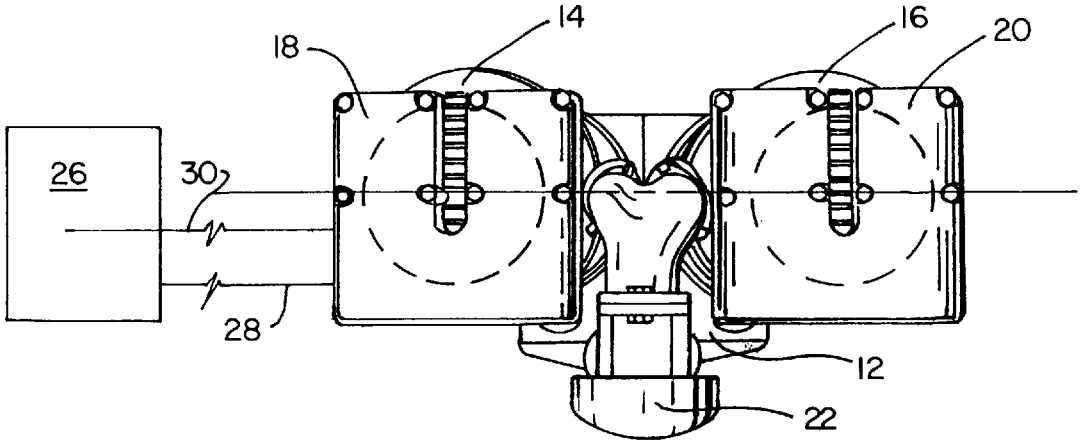
FIG. 2 is a plan view, partially schematic, of the internal combustion engine illustrated in FIG. 1.

FIGS. 1 and 2 illustrate components of an internal combustion engine 10 constructed in accordance with the present invention. Such components include a conventional cast and machined engine base housing 12, air-cooled cylinder assemblies 14 and 16 mounted on base housing 12, cylinder heads 18 and 20 joined to cylinders 14 and 16, respectively, and conventional air cleaner component 22. Cylinder heads 18 and 20 each contain conventional cylinder intake and exhaust valves in their interior. Also, comprising engine assembly 10 are attached lubricating oil pump 24, a remote lubricating oil reservoir 26, and supply and return fluid lines 28 and 30 that functionally inter-connect pump 24 and lubricant reservoir 26. Also illustrated in FIG. 1 is an internal fluid passageway 32 that supplies pressurized lubricant from oil pump 24 to an internal passageway 36 provided in the engine crankshaft subassembly 34 (see FIGS. 3 and 7) for distributing lubricant to internal engine connecting rod bearings.

Figure 3:
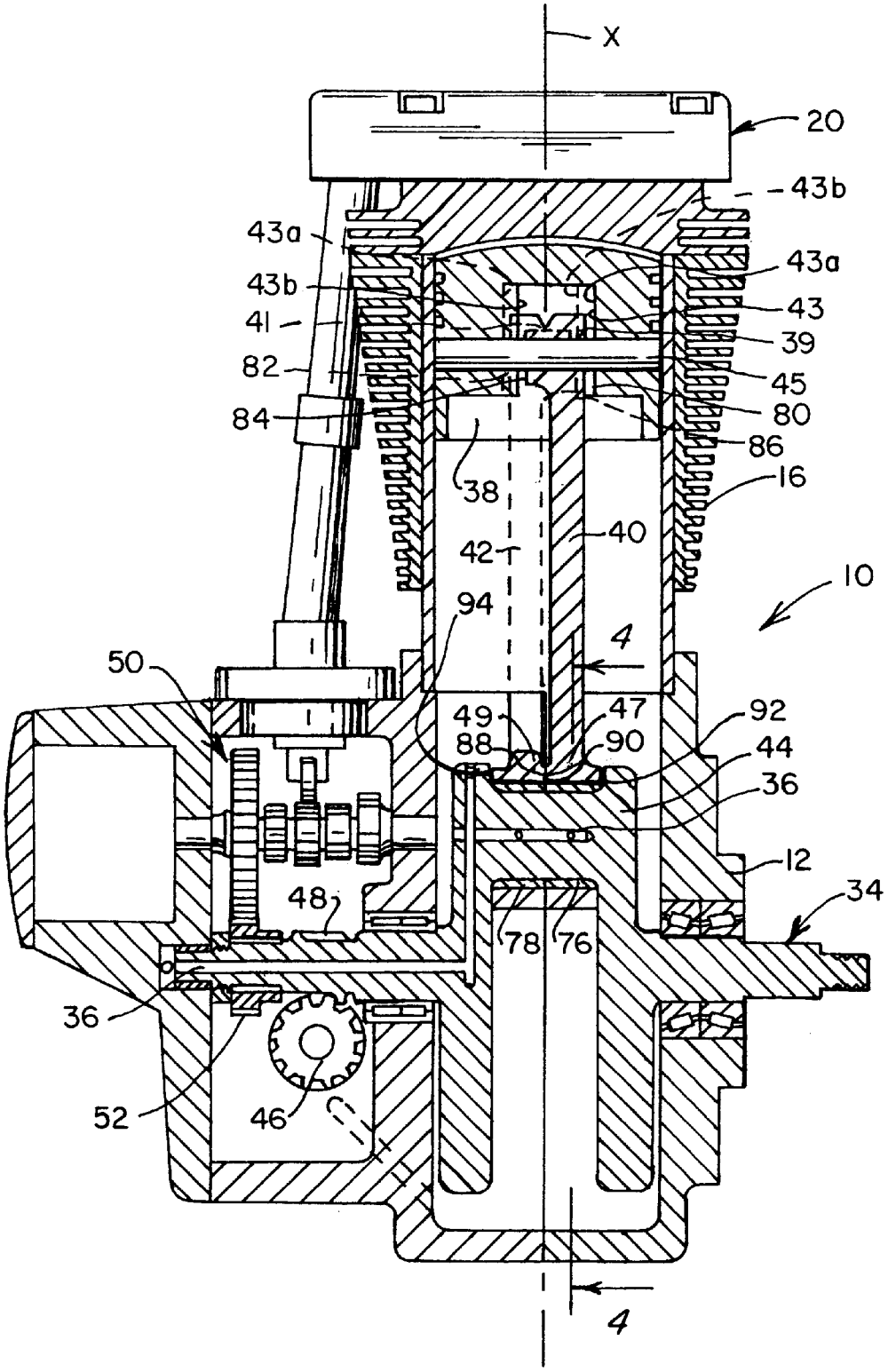
FIG. 3, is an elevation section view principally of the cylinder and engine block components of the engine of FIGS. 1 and 2 taken at line 3—3 of FIG. 1.
Figure 4:
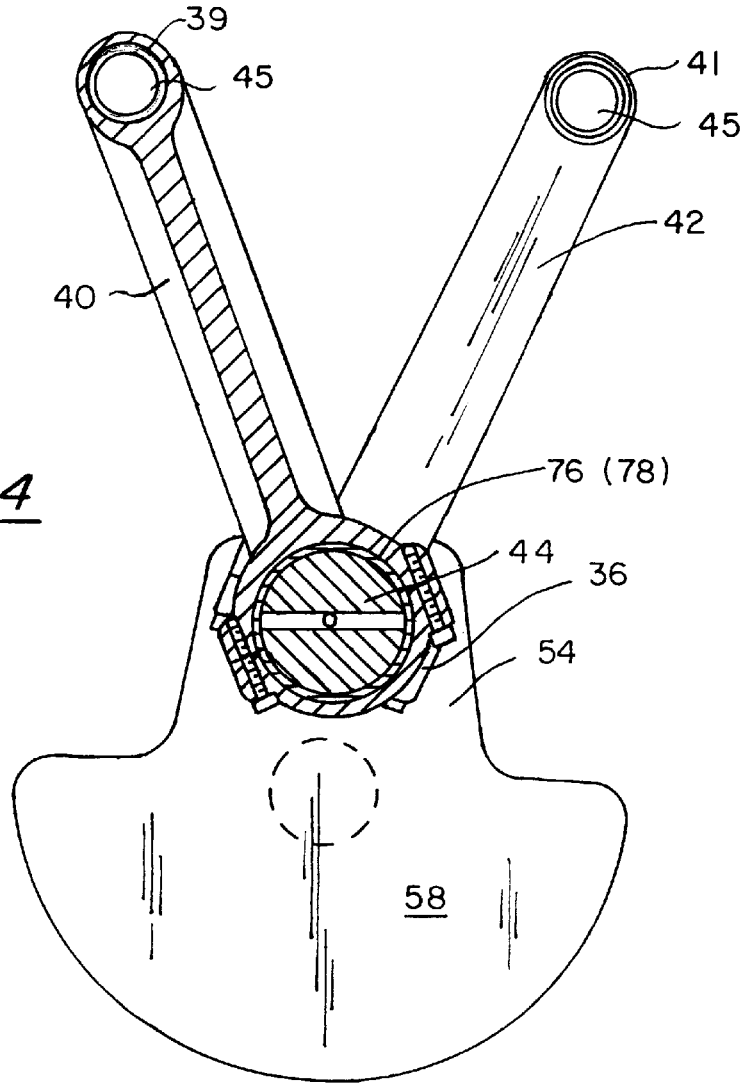
FIG. 4 is a section view taken at line 4—4 of FIG. 3.

Referring to FIG. 3, other important components of internal combustion engine 10, include a pair of co-planar pistons 38 (only one of which appears in the Figure) positioned within respective cylinders 14 and 16, non-co-planar connecting rod elements 40 and 42 having outer or wrist pin ends 39 and 41 received in rod sockets 43 of pistons 38 (which sockets are defined by side walls or bosses 43*a* and 43*b* and are offset from the longitudinal axis of piston 38) and connected thereto by wrist pins 45 (see also FIG. 4) which rod elements 40 and 42 have crank ends 47 and 49 mounted on sleeve bearings 76 and 78 to connect piston elements 38 to a singular crank pin element 44 of crankshaft subassembly 34, a lubricant pump drive gear 46 driven by a crank drive gear 48 of crankshaft subassembly 34, and an intake/exhaust valve actuator train 50 driven by a pinion gear 52 of crankshaft subassembly 34. Preferably crank drive gear 48 is formed integrally on crankshaft subassembly 34 to eliminate having to reduce the size of subassembly 34 at drive gear 48 which becomes necessary when drive gear 48 is a separate element. It has been found that on occasion subassembly 48 fails at the area where the shaft size has been reduced to accept a separate drive gear 48.

As illustrated in FIG. 7, crankshaft subassembly 34 is a unitary assembly comprised of several joined shaft elements that include single crank pin element 44, crank arm elements 54 and 56 that each respectively further includes a counterweight portion 58 or 60 and that each is rigidly connected to a respective end of crank pin element 44, a sprocket shaft element 62 rigidly connected to crank arm element 56, and a pinion shaft element 64 rigidly connected to crank arm element 54. It is preferred that counterweight elements 58 and 60 be of uniform thickness throughout their radial extent. Also, such counterweight elements are preferably rigidly joined to crank pin 44 by welding. However, and as shown in FIG. 7, shaft elements 62 and 64 may be removably joined to crank arm/counterweight combinations 54,58 and 56,60 by a threaded nut fastener. Alternately, the shaft elements 62 and 64 and the crank arm/counterweight combinations 54, 58 and 56, 60 may be a unitary forged assembly. Lubricant distribution passageway 36 basically is located and contained interiorly of pinion shaft element 64, a portion of crank arm element 54, and a portion of single crank pin element 44, and is supplied with high-pressure lubricant from a outlet of lubricant pump 24. Sprocket shaft element 62 includes a splined section 66 upon which an output drive sprocket or drive gear may be mounted.

Figure 5:
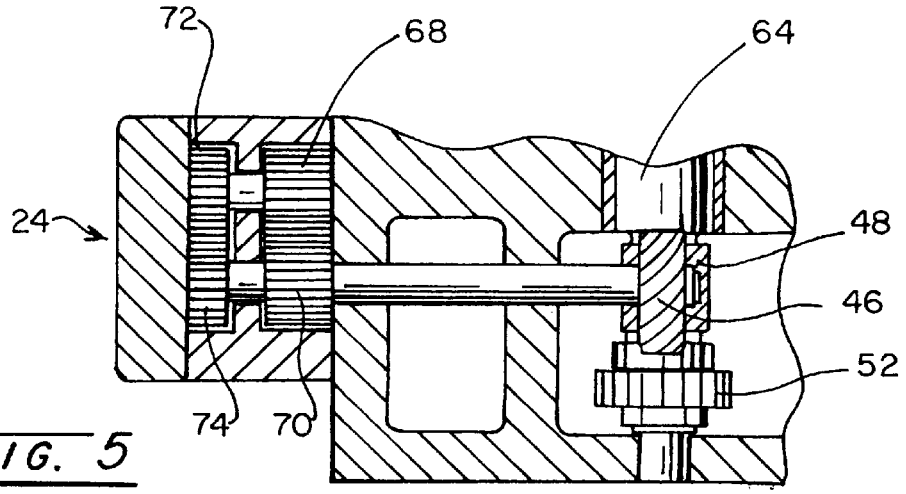
FIG. 5 is a partial plan section view of the engine lubricating oil pump and pump drive components of the engine of FIGS. 1 and 2 taken at line 5—5 of FIG. 1.

FIGS. 5 and 6 basically provide additional details of lubricant pump 24 which includes two gear sets 68,70 and 72,74. Gear set 68,70 is a scavenger gear set which functions to pump lubricant from the crankcase region of engine housing 12 to lubricant reservoir 26 through lubricant return line 30. Gear set 72, 74 receives lubricant from lubricant reservoir 26 through fluid line 28 and its pressurized output is ported to the end of pinion shaft element 64 for distribution through passageway 36 to lubricant outlet ports provided in the singular crank pin element 44 of crankshaft subassembly 34 and its co-operating sleeve bearing subassemblies 76 and 78. (See FIGS. 3 and 4). Sleeve bearing subassemblies preferably are made of a conventional bronze alloy. It is preferred that the scavenger gear set 68,70 of lubricant pump 24 have a volumetric output that is greater than the volumetric output of the gear set 72, 74 that lubricates internal connecting rod sleeve bearings 76, 78 and such is accomplished essentially by having wider gear teeth, preferably at a ratio of 2:1, than the gear teeth in gear set 72,74.

It is an important aspect of the present invention that even though cylinders 14 and 16, and their internal piston elements 38, have longitudinal axes that lie in the same right-angled plane of reciprocation relative to the rotational axis of crankshaft element 34, the longitudinal axes of connecting rod elements 40 and 42 do not lie in that plane but are offset equal distances laterally with respect to it. See FIG. 3. As mentioned above, rod sockets 43 which receive the wrist pin ends 39 and 41 of rod elements 40 and 42 are defined by bosses 43*a* and 43*b* which are spaced unequal distances from the longitudinal axis X of piston 38. Referring to FIG. 3 it may be seen that boss 43*a* has been machined down or offset a greater distance from the piston axis X than boss 43*b*. Additionally the faces 80 and 82 of wrist pin ends 39 and 41 of rods 40 and 42 respectively which lie adjacent bosses 43*a* are machined down or offset a greater distance from the longitudinal axis of connecting rods 40 and 42 than are the faces 84 and 86 which lie adjacent bosses 43*b*. Similarly, inner faces 88 and 90 at the crank ends 47 and 49 of rods 40 and 42 which lie on the sides of the rods opposite the offset faces 80 and 82 are machined down or offset a greater distance from the longitudinal axis of connecting rods 40 and 42 than are the outer faces 92 and 94. Said crank end offsets 88 and 90 abut each other when said rods 40 and 42 are mounted on crank pin element 44. Thus, it may be seen that the offsets 80 and 88 of rod 40 and the offsets 82 and 90 of rod 42 function to reduce the width of the rods 40 and 42 in a plane perpendicular to the axes of wrist pins 45 and crank pin element 44.

The connecting rod offsets in conjunction with the offsets 43*a* formed in the piston sockets 43 enable the offset connecting rods 40 and 42 to occupy the same space and thus directly replace coplanar connecting rod elements that are joined to an engine crankshaft assembly crank pin element by means of a combination of straight and clevis type connecting rod ends. Although, it is possible the offset connecting rods may be utilized in pistons having sockets aligned with the longitudinal axis of the piston, it is preferred to utilize offset piston sockets or wrist pin bosses in conjunction with the offset rods to enable the assembly to adhere to a preferred construction in which the width of the wrist pin end of a connecting rod is equal to or greater than 1.5 times the diameter of the wrist pin.

Use of the side by side connecting rod placement in engine 10 permits the use of a larger diameter crankshaft crankpin element 44 and eliminates the need for utilization of a forked rod end on one of the engine connecting rods as is the current conventional practice. Also, connecting rod elements 40 and 42 preferably have identical external configurations and are joined to piston elements 38 through the illustrated wrist pin connections in a reversed manner.

Further, it is preferred that the outlet ports of the internal lubricant passageway 36 provided in crankpin element 44 for lubricating sleeve bearings 76 and 78 be located at positions that are positioned approximately 90° and 270° from a position on the connecting rod longitudinal axis when their respective piston element 38 is positioned either at top or bottom dead center in its piston stroke. Because such outlet ports are so-positioned, a maximum volume of lubricant is assuredly ported to a region between the surface of the crankpin element and the underside of the sleeve bearing in a zone where there is maximum clearance space rather than a zone such as top dead center where the maximum piston load that is transmitted to the crankpin element occurs.

It should be understood that all descriptions and illustrations made in connection with the foregoing preferred embodiment of my invention are to be interpreted in an illustrative sense and not in a limiting manner. It will be apparent to those skilled in the art that various changes in the configuration of the invention elements may be made without departing from the scope, meaning, or intent of the claims which follow.

I claim as my invention:

1. In a 2-cylinder, V-type internal combustion engine having a crankshaft and an engine transverse reference plane that is oriented at right-angles to the longitudinal axis of the crankshaft, in combination:

a pair of generally-opposed piston cylinders each having a longitudinal axis that is in the engine transverse reference plane;

a pair of reciprocable piston elements respectively installed in said piston cylinders and each having a longitudinal axis that is in the engine transverse reference plane;

a crankshaft single crankpin element positioned intermediate a pair of crankshaft crank arm elements;

a pair of connecting rod elements that co-operate with said pair of piston elements and with said crankshaft single crankpin element; and a pair of sleeve-type bearing elements axially aligned along the longitudinal axis of said crankshaft single crankpin element and positioned intermediate said connecting rod elements and said crankshaft single crankpin element, each one of said pair of connecting rod elements having a longitudinal axis that is offset to a different side of said engine transverse reference plane and at an offset distance that corresponds to the offset distance of the other of said pair of connecting rod elements.

2. The 2-cylinder, V-type internal combustion engine of claim 1 wherein each of said piston elements has a rod socket, said rod sockets each having an axis of symmetry that is offset equally from and to an opposite side of the engine transverse reference plane.

3. The 2-cylinder V-type internal combustion engine of claim 1 and further comprised of an internal passageway in-part located within said crankshaft crankpin element, said internal passageway receiving pressurized lubricant from the engine lubricant pump and porting pressurized lubricant received from the engine lubricant pump to zones which lie between the inner surfaces of said sleeve-type bearing elements and the surface of said crankshaft crankpin element and which are at approximately 90° and 270° positions relative to the longitudinal axes of said piston elements when said piston elements are positioned at top or bottom dead center in their respective operating strokes.

4. The 2-cylinder V-type internal combustion engine of claim 3 further comprising a scavenger pump located in the engine crankcase for pumping lubricant from said crankcase to a lubricant reservoir and wherein said scavenger pump has a greater volumetric output than said lubricant pump to ensure that said lubricant pump has a constant supply of lubricant.

* * * * *